US007484323B2

(12) United States Patent
Morin

(10) Patent No.: US 7,484,323 B2
(45) Date of Patent: Feb. 3, 2009

(54) EXCAVATING TOOL FOR HYDRAULIC SHOVEL

(75) Inventor: Marcel Morin, Beaugency (FR)

(73) Assignee: Klac Industrie, Olivet (FR)

( * ) Notice: Subject to any disclaimer, the term of this patent is extended or adjusted under 35 U.S.C. 154(b) by 379 days.

(21) Appl. No.: 11/036,985

(22) Filed: Jan. 19, 2005

(65) Prior Publication Data

US 2005/0173136 A1 Aug. 11, 2005

Related U.S. Application Data

(63) Continuation of application No. PCT/FR03/001758, filed on Jun. 12, 2003.

(30) Foreign Application Priority Data

Jul. 23, 2002 (FR) ..... 02 09305
Mar. 26, 2003 (FR) ..... 03 03680

(51) Int. Cl.
*E02F 3/96* (2006.01)

(52) U.S. Cl. ..... 37/404; 37/444; 414/722

(58) Field of Classification Search ..... 37/468, 37/444, 403, 404–410; 414/724, 722
See application file for complete search history.

(56) References Cited

U.S. PATENT DOCUMENTS 449,517 A * 3/1891 Bodenstein ..... 299/24
2,416,409 A 2/1947 Schield
2,660,323 A * 11/1953 Carlesimo ..... 37/444
3,032,900 A 5/1962 Kashergen
3,684,030 A * 8/1972 Lucero ..... 172/700
3,724,899 A * 4/1973 Clark ..... 299/26
3,778,111 A * 12/1973 Ciofani ..... 299/67
3,788,085 A * 1/1974 Holberg ..... 405/164
3,959,900 A 6/1976 Luck
3,973,509 A * 8/1976 Waas ..... 114/42
4,037,337 A * 7/1977 Hemphill ..... 37/444
4,077,529 A * 3/1978 Leyrat et al. ..... 414/722
4,085,530 A 4/1978 Landry
4,269,541 A * 5/1981 Altmann ..... 405/181
4,279,085 A * 7/1981 Arnold ..... 37/444
4,351,397 A * 9/1982 Winker ..... 172/464
4,516,339 A * 5/1985 Hemphill ..... 37/454

(Continued)

FOREIGN PATENT DOCUMENTS

DE 9103099 9/1991

(Continued)

OTHER PUBLICATIONS

English Language Abstract of JP 2000-178999.

(Continued)

*Primary Examiner*—Thomas A Beach
(74) *Attorney, Agent, or Firm*—Greenblum & Bernstein, P.L.C.

(57) ABSTRACT

Tool designed to be fixed at the end of the arm of a shovel. The tool includes a curvilinear blade formed by a portion of a straight cylindrical surface whose generating lines extend parallel to an axis of rotation of the tool on the arm. This Abstract is not intended to define the invention disclosed in the specification, nor intended to limit the scope of the invention in any way.

18 Claims, 6 Drawing Sheets

U.S. PATENT DOCUMENTS

| | | | | | |
|---|---|---|---|---|---|
| 4,808,027 | A | * | 2/1989 | Anderson | 404/127 |
| 4,896,444 | A | * | 1/1990 | Sieber et al. | 37/444 |
| RE33,198 | E | * | 4/1990 | Ballinger | 37/444 |
| 5,062,228 | A | * | 11/1991 | Artzberger | 37/407 |
| 5,244,306 | A | * | 9/1993 | Artzberger | 404/128 |
| 5,695,012 | A | * | 12/1997 | Kesting | 172/699 |
| 5,755,048 | A | * | 5/1998 | Lee | 37/403 |
| 6,490,815 | B1 | * | 12/2002 | Pratt | 37/408 |
| 2006/0070267 | A1 | * | 4/2006 | Horton | 37/404 |

FOREIGN PATENT DOCUMENTS

| | | |
|---|---|---|
| DE | 10114707 | 10/2002 |
| FR | 2785951 | 5/2000 |
| FR | 2794932 | 12/2000 |
| GB | 2347921 | 9/2000 |
| JP | 10-140597 | 5/1998 |
| JP | 2000-178999 | 6/2000 |
| SU | 1745823 | 7/1992 |

OTHER PUBLICATIONS

English Language Abstract of JP 10-140597.

* cited by examiner

Fig.3
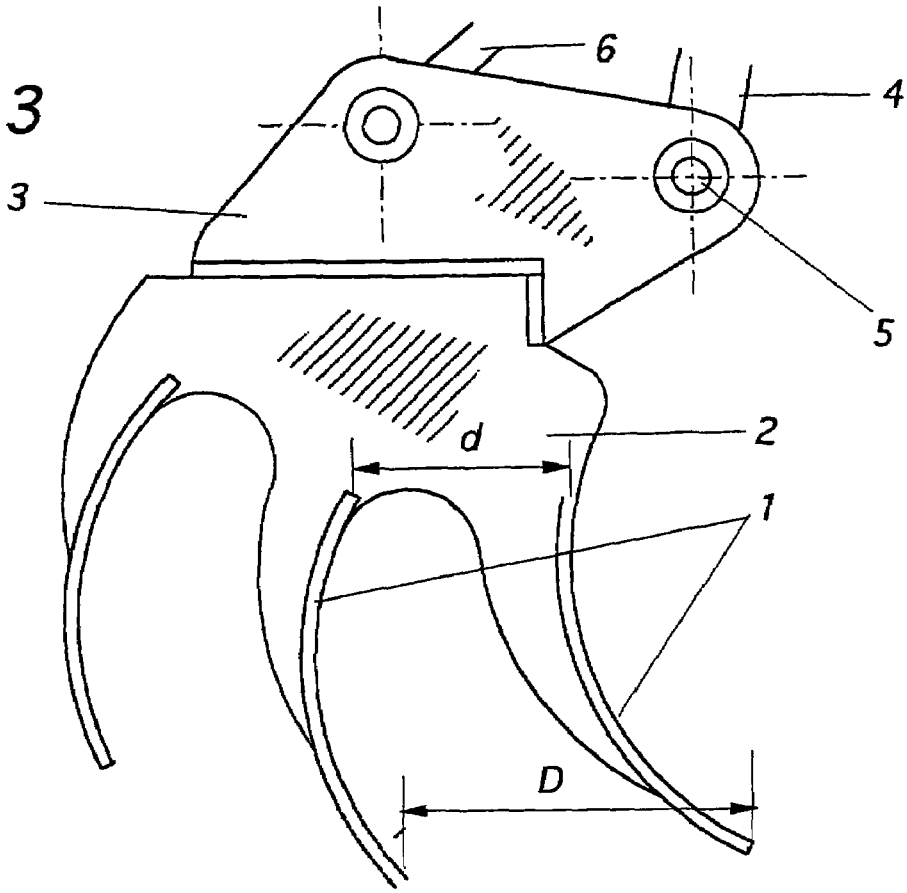
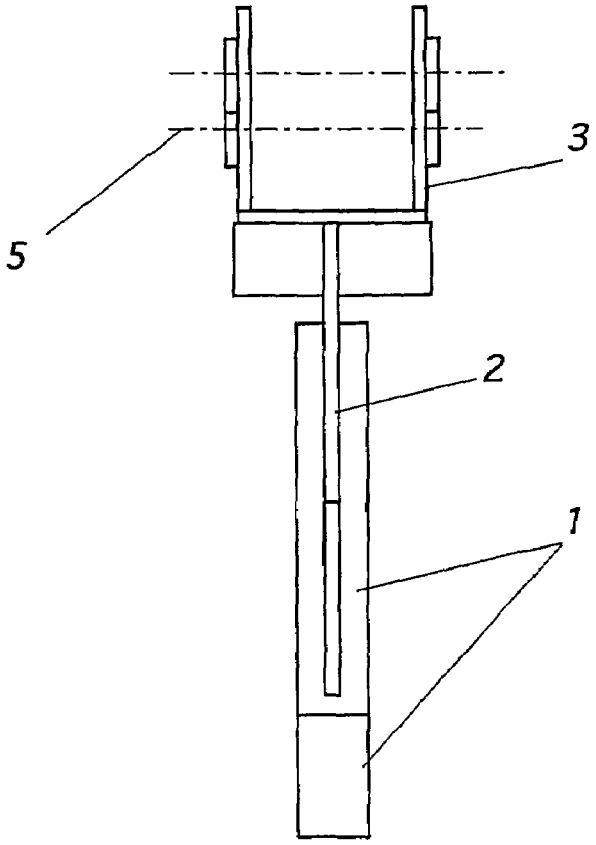
Fig.4

EXCAVATING TOOL FOR HYDRAULIC SHOVEL

CROSS-REFERENCE TO RELATED APPLICATIONS

The present application is a Continuation of International Patent Application No. PCT/FR2003/001758 filed Jun. 12, 2003, and claims priority of French Patent Application No. 02/09305 filed Jul. 23, 2002 and French Patent Application No. 03/03680 filed Mar. 26, 2003. Moreover, the disclosure of International Patent Application No. PCT/FR2003/001758 is expressly incorporated by reference herein in its entirety.

BACKGROUND OF THE INVENTION

1. Field of the Invention

The present invention relates to an excavating tool of the type that is articulated at the end of an hydraulic shovel.

2. Background and Material Information

In the current state of the art, buckets are used whose width substantially demarcates the width of the trench to be dug.

The use of this tool poses problems with respect to emptying it. For example, the soil sticks to the bottom of the bucket and its side walls. Tests have shown that the use of an ejecting paddle not only increases the cost of the bucket, but also does not perform satisfactorily on very loamy soils.

Tests have also shown that it is almost impossible to manufacture buckets to dig trenches having a width on the order of 30 centimeters, and capable of digging down to a depth of up to about one meter. Indeed, in order to accomplish this, one needs to manufacture a very elongated bucket, and the surface of the lateral sides are large for a relatively small mass of earth: the forces due to friction are substantial and emptying the bucket is almost impossible.

The document U.S. Pat. No. 3,032,900 describes a tool which has concentric blades connected to a bottom by one of their ends, and to a sheet which extends in the median plane of the tool by one of their edges.

This tool does not perform satisfactorily because the earth sticks to the bottom and each side of the sheet.

SUMMARY OF THE INVENTION

The instant invention, which remedies these disadvantages, is characterized in that the tool is constituted by a curvilinear blade affixed by its rear surface to a substantially vertical sheet, connected to the shovel's arm in the usual way.

This blade is formed by a portion of a straight cylindrical surface, the generating lines of which extend substantially parallel to the articulation axis of the tool with respect to the shovel's arm.

According to one characteristic of the invention, the blade has openings so as to reduce the contacts between the soil and the tool.

The tool of the present invention, which remedies these disadvantages, can have a plurality of curvilinear blades and is characterized in that the curvilinear blades are angularly offset so that the distance between the lower ends of two adjacent blades is greater than that separating the upper ends of the blades.

The distance separating the articulation axis of the tool on the shovel's arm from the lower end of each blade can increase from the first to the last, whereby the first blade is the one that first penetrates into the earth.

The invention also provides for a tool that is attachable to an end of an arm of a shovel, wherein the tool comprises at least one curvilinear blade.

The at least one blade may comprise a straight cylindrical surface, whereby lines generating the cylindrical surface extend parallel to a rotation axis of the tool on the arm. The at least one blade may comprise openings. The at least one blade may comprise a plurality of blades angularly offset from one another. The at least one blade may comprise two adjacent blades, wherein a distance separating upper ends of the two adjacent blades is smaller than a distance separating lower ends of the two adjacent blades.

The at least one blade may comprise a plurality of blades angularly offset from one another and wherein a distance between an articulation axis of the tool and a lower end of each of the plurality of blades increases from a first of the plurality of the blades to a last of the plurality of the blades. During excavation, the first blade may be configured to penetrate into earth before the last blade.

The at least one blade may be removably mounted to the tool. The tool may further comprise a sheet member having at least one base portion, wherein the sheet member is arranged to couple the at least one blade to a cap portion of the tool. The sheet member may comprise a concave surface which corresponds to a convex surface of the at least one blade.

The tool may further comprise a sheet member and an arrangement for fixing the at least one blade to the sheet member.

The at least one blade may comprise first and second blades and wherein the tool further comprises a sheet member that is configured to connect each of the first and second blades to a cap portion of the tool.

The at least one blade may comprise first and second removably mounted blades and wherein the tool further comprises a sheet member that is configured to connect each of the first and second removably mounted blades to a cap portion of the tool.

The invention also provides for a tool that is attachable to an end of an arm of a shovel, wherein the tool comprises a cap portion arranged to pivot with respect to the end of the arm, at least one blade member comprising a convex rear surface, a concave surface, and a soil engaging end, and a sheet member comprising a first edge connected to a surface of the cap portion and a second edge connected to the convex rear surface of the at least one blade.

A thickness of the sheet member may be less than a width of the at least one blade member. The at least one blade member may comprise openings. The first edge may be connected to a central portion of the surface of the cap portion and the second edge may be connected to a central portion of the convex rear surface of the at least one blade member.

The at least one blade member may comprise two adjacent blade members, wherein a distance separating upper ends of the two adjacent blade members is smaller than a distance separating lower ends of the two adjacent blade members. The at least one blade member may be removably mounted to the sheet member. The second edge of the sheet member may comprise a concave surface which corresponds to the convex rear surface of the at least one blade member. The at least one blade member may comprise first and second removably mounted blade members and wherein the sheet member connects each of the first and second removably mounted blades to the cap portion of the tool.

The invention also provides for an excavating tool comprising a cap portion comprising a mechanism for pivotally mounting the excavating tool to an end of an arm, at least one blade member comprising a convex rear surface, a concave surface, and a soil engaging end, and a sheet member comprising a first edge connected to a central portion of a surface of the cap portion and a second concave edge connected to a central portion of the convex rear surface of the at least one blade.

BRIEF DESCRIPTION OF DRAWINGS

Other characteristics of the invention will be better understood from the following description, with reference to the annexed drawings provided by way of example only, wherein:

FIG. 3 shows a side view of another embodiment of a tool according to the invention;

FIG. 4 is a rear view of FIG. 3;

DETAILED DESCRIPTION OF THE INVENTION

Figure 1:
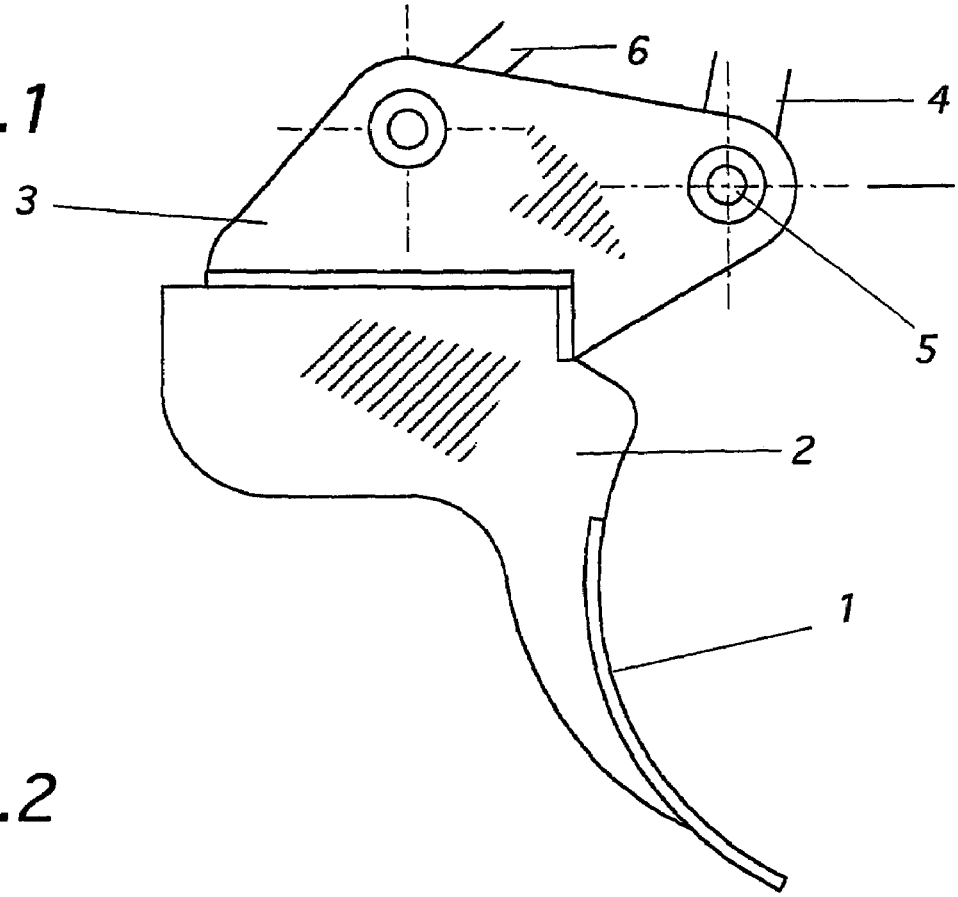
FIG. 1 shows a side view of one embodiment of a tool according to the invention.
Figure 2:
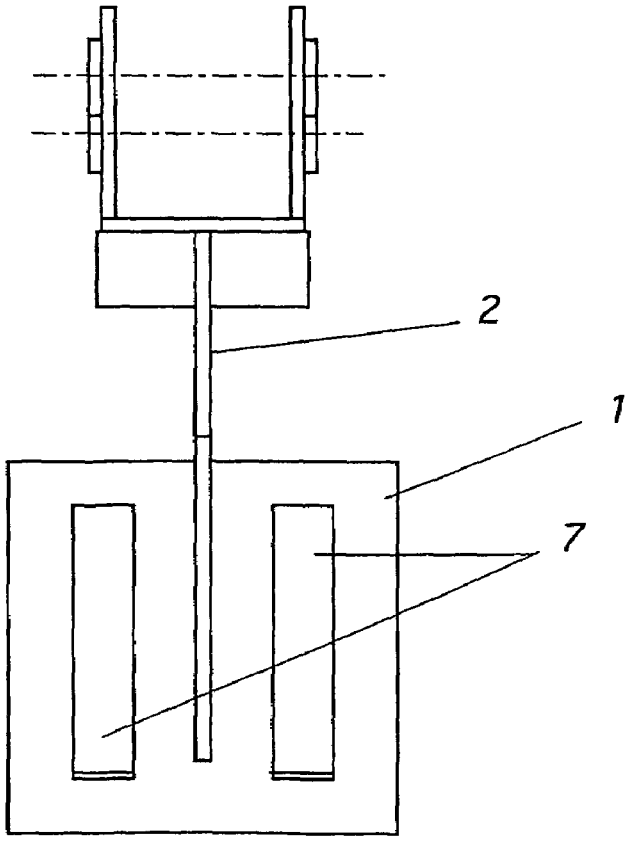
FIG. 2 shows a rear view of FIG. 1.

The tool of the invention is made of a curvilinear blade 1 that is borne by a central sheet 2 arranged behind the blade 1. The sheet 2 is affixed to a regular cap 3 for fixing the tool to the end of a shovel's arm 4 by way of a shaft 5. In a known fashion, there is provided a cylinder whose stick 6 allows the tool to be pivoted about the axis of the shaft 5.

The blade 1 is constituted by a portion of a straight cylindrical surface whose generating lines extend parallel to the axis of the shaft 5.

In general, the fixing of the tool can be accomplished by way of a quick connector such as the one described in the French Patent No. 2 785 951.

The blade 1 can have openings 7 which function to reduce the surface of the blade 1 that comes into contact with the soil.

According to the embodiment shown in FIG. 3, the tool has a plurality of blades 1 which are angularly offset. In this regard, the distance "d" which separates the upper ends of two adjacent blades 1 is smaller than the distance "D" which separates the lower ends of the blades 1.

It should be noted that the portion of the surface of the sheet 2 that extends behind the blades 1 is insignificant.

The blades 1 are preferably identical to each other, and their width can define the width of the trench to be dug.

Figure 5:
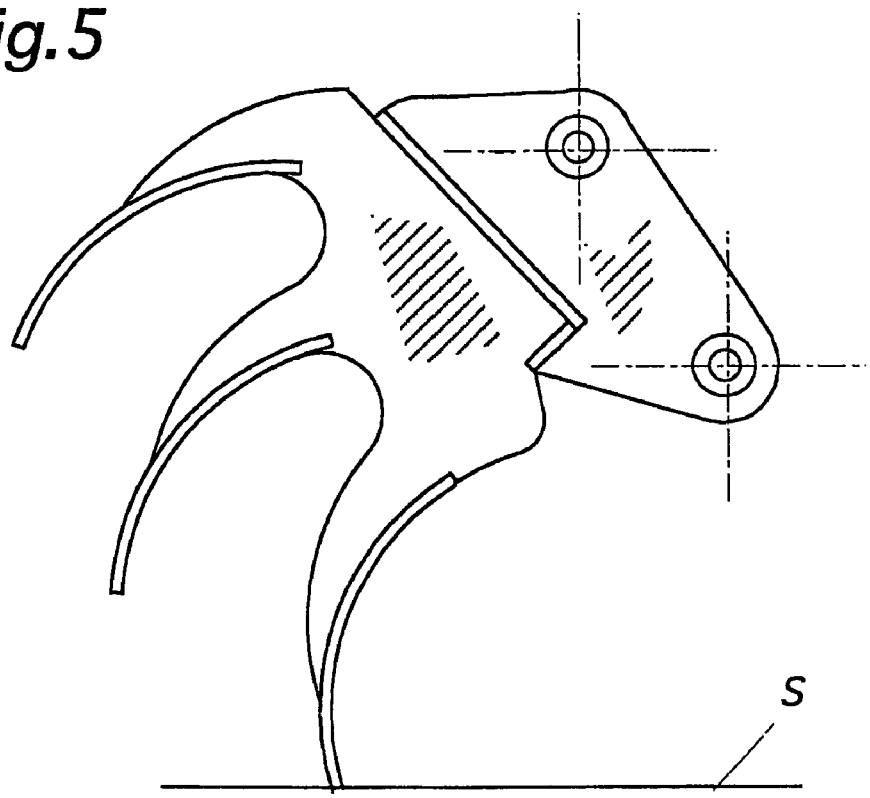
FIGS. 5-8 show the embodiment of FIG. 3 in use.
Figure 6:
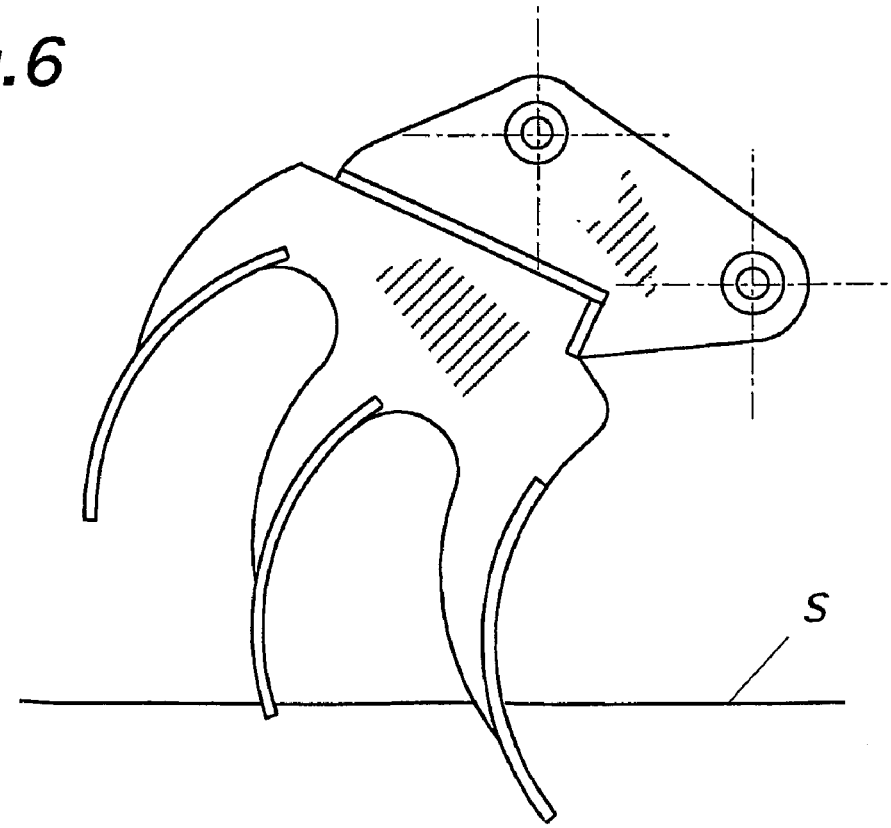
Figure 7:
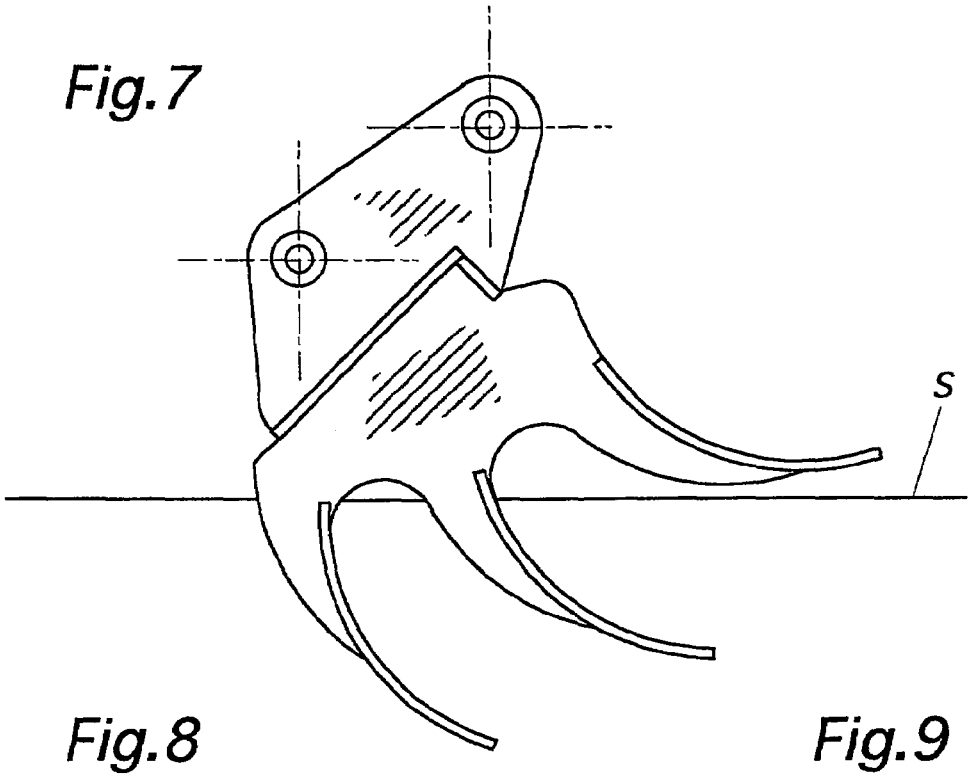

In addition to the blades 1 being angularly offset, the distance between an axis of the shaft 5 and an end of a corresponding blade can increase in the direction of rotation of the tool during penetration into the ground S (counterclockwise direction shown in FIGS. 5-7).

Figure 8:
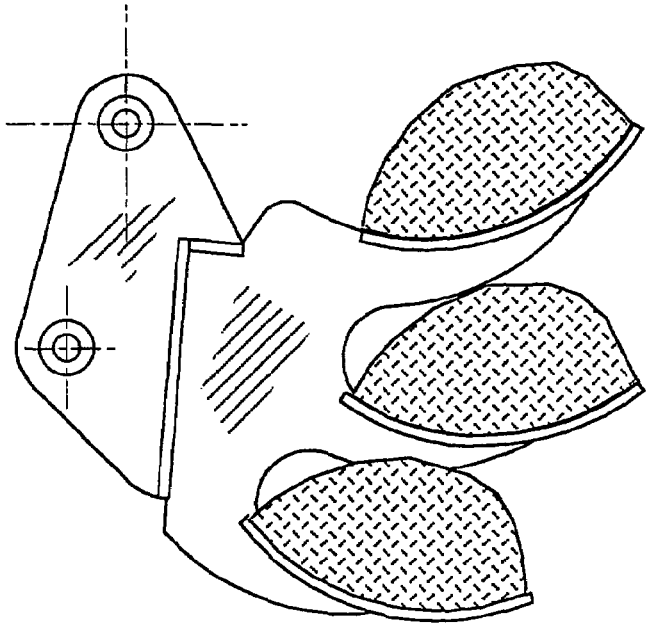
Figure 9:
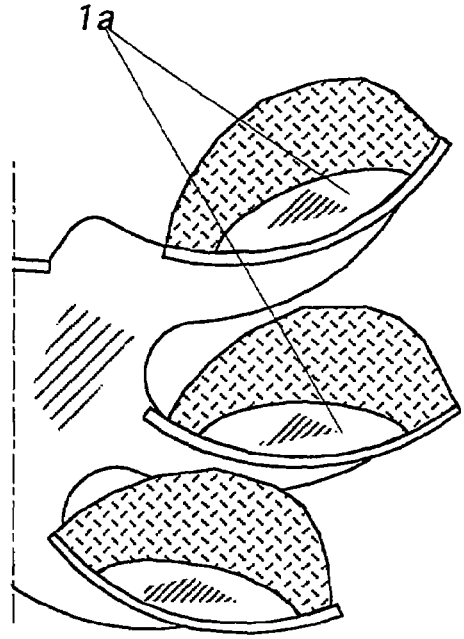
FIG. 9 shows an alternative embodiment similar to FIG. 8.

FIG. 8 shows the position of the tool after it has come out from the trench. When the ground is very sandy, the dug soil may partially crumble laterally. In this case, and as is seen in FIG. 9, retaining edges 1*a* are provided on each blade 1. The surface of these edges 1*a* is very small in order not to create ill-timed friction which could have a negative effect on the penetration of the tool into the ground S and the removal of the dug out soil.

According to another characteristic of the invention, the blades 9 can be removable.

Along these lines and according to another embodiment, the sheet 2 has bases 8. The corresponding blade is fixed on each base 8 by any appropriate arrangement and each base 8 is configured to fit the convex surface of the blade, which is preferably a straight cylindrical surface with a circular directing line.

As seen in FIGS. 10-13, each blade has a fixing arrangement. According to this embodiment, the convex surface of each blade 9 has a yoke 10 arranged on its lower end and a cap 11 arranged on its upper end. The wings of the sheet 2 of the tool can be inserted between the parts 10 and 11.

Figure 10:
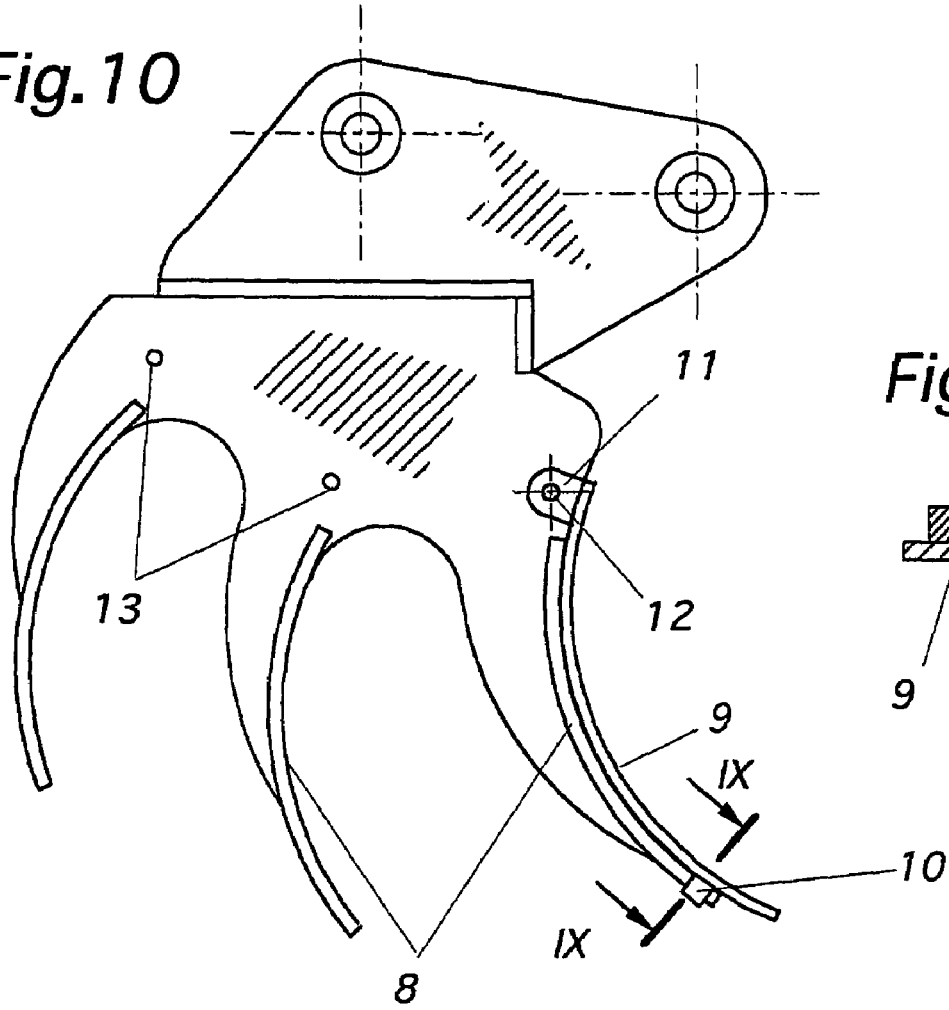
FIG. 10 shows another embodiment of the tool and which is similar to the one of FIG. 3.
Figure 11:
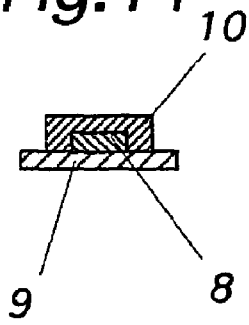
FIG. 11 shows a cross-sectional view, straightened out, along the line XI-XI of FIG. 10.
Figure 12:
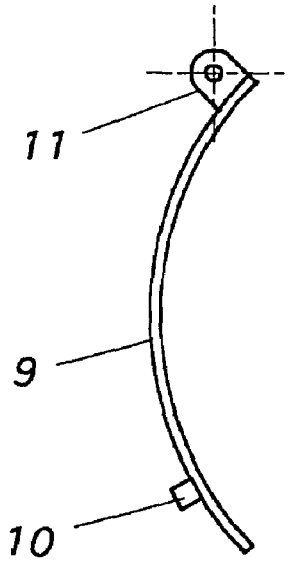
FIG. 12 shows a side view showing a blade used in the embodiment of FIG. 10.
Figure 13:
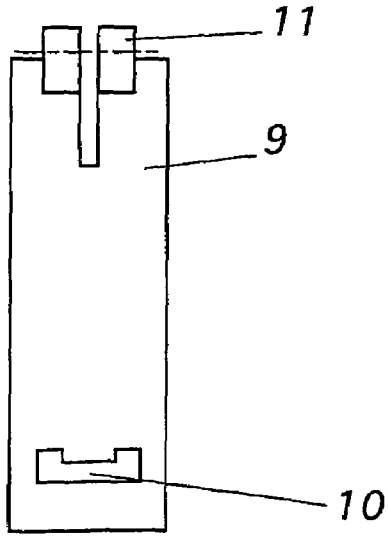
FIG. 13 shows a rear view of FIG. 12.

The blade 9 is retained in the position of FIG. 10 via a pin 12. In this regard, holes 13 are provided for this purpose on the sheet 2. In order to mount the blade 9, it is first engaged on the sheet 2, then slid downward so that the yoke 10 is located above the lower end of the base 8. While keeping the blade 9 pressed against the base 8, it is slid upward so that the lower end of the base 8 penetrates into the yoke 10 and, finally, the pin 12 which retains the blade 9 is positioned in the hole. The disassembling can be accomplished in reverse order.

It should be noted that the invention contemplates that the blades of the same tool can vary as much in width as in length.

Figure 14:
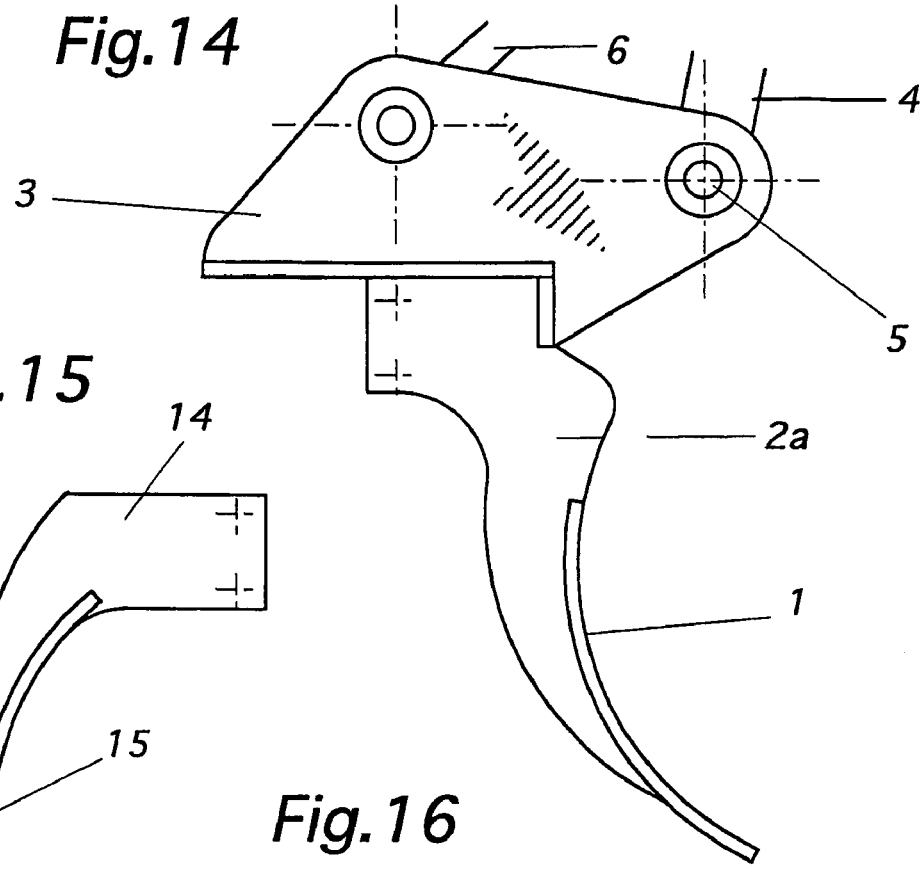
FIGS. 14-16 are side views showing how a tool with one blade can be transformed into a tool with several blades.
Figure 15:
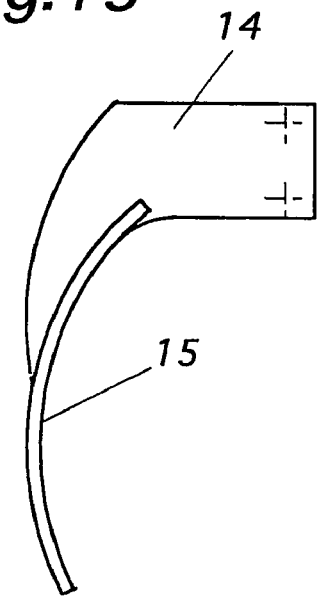
Figure 16:
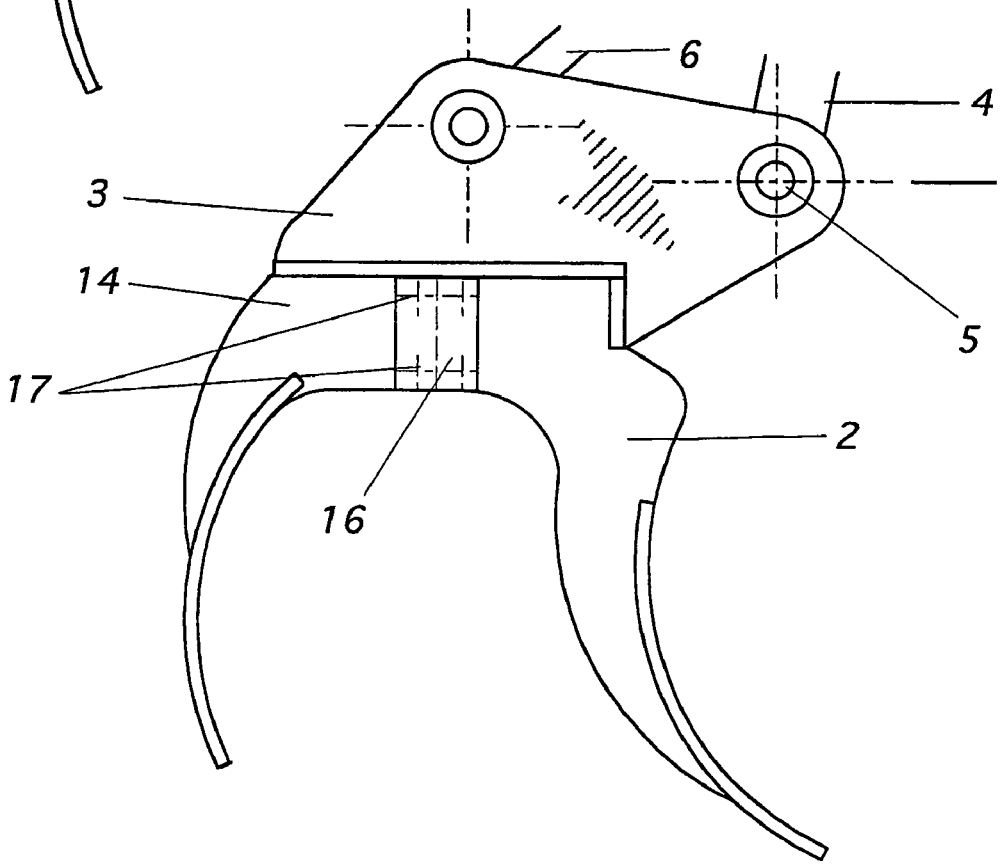

FIG. 14 shows another embodiment of the tool of FIG. 1 wherein a sheet 2*a* is shaped to cooperate with the sheet 14 of a blade 15 (see FIG. 15) in order to make a two-blade tool from a single-blade tool, as shown in FIG. 16.

The fixing of the blade 15 of FIG. 15 is accomplished, for example, by way of two plates 16, arranged on each side of the sheets 2 and 14, and retained by bolts. The bolts are illustrated as axes 17. It should be noted that the sheet 14 can also be shaped so as to enable the fixing of a third blade.

In the examples described and shown, the sheets are formed as portions of cylindrical surfaces with a circular directing line.

It is possible, however, within the scope of the invention, to make curvilinear blades wherein the directing line no longer has the appearance of a continuous curve but rather that of a polygonal line. For example, a polygonal line that can fit in a circle arc can be utilized.

Along the same lines, the curvilinear blade of the invention can be obtained by folding a flat blade in the same direction, whereby the various folds form a relatively small angle with the articulation axis of the tool with respect to the arm.

What is claimed is:

1. A tool attachable to an end of an arm of a shovel, the tool comprising:

at least two adjacent curvilinear blades;

a sheet member comprising a first edge connected to a convex rear surface of one of the two adjacent blades and a second edge connected to a convex rear surface of another of the two adjacent blades, wherein a distance separating upper ends of the two adjacent blades is smaller than a distance separating lower ends of the two adjacent blades, and wherein a distance between the two adjacent blades measured at an angular midpoint between the upper and lower ends is smaller than the distance separating lower ends and greater than the distance separating the upper ends of the two adjacent blades.

2. The tool of claim 1, wherein the sheet member comprises an open area between the at least two blades which narrows to an inwardly curved edge.

3. The tool of claim 1, wherein each of the first and second edges comprise a concave edge which is connected to a respective convex rear surface of the two adjacent curvilinear blades, and wherein a distance separating the two adjacent curvilinear blades increases continuously between the upper ends and the lower ends.

4. The tool of claim 1, wherein an area of the sheet member between the two adjacent curvilinear blades defines an open area between the upper ends and the lower ends, wherein each of the first and second edges is arranged on a portion of the sheet member that is tapered and narrows from an area of the upper ends to an area of the lower ends, and wherein the two adjacent curvilinear blades are identical to each other.

5. A tool that is attachable to an end of an arm of a shovel, the tool comprising:

a cap portion arranged to pivot with respect to the end of the arm;

at least two blade members each comprising a convex rear surface, a concave front surface, and a soil engaging end; and a sheet member comprising a first edge connected to a surface of the cap portion and a second edge connected to the convex rear surface of one of the at least two blade members, wherein a distance separating upper ends of the at least two blade members is smaller than a distance separating lower ends of the at least two blade members, and wherein a distance between the two adjacent blades measured at an angular midpoint between the upper and lower ends is smaller than the distance separating lower ends and greater than the distance separating the upper ends of the two adjacent blades.

6. The tool of claim 5, wherein a thickness of the sheet member is less than a width of one of the at least two blade members.

7. The tool of claim 5, wherein one of the at least two blade members comprises openings.

8. The tool of claim 5, wherein the first edge is connected to a central portion of the surface of the cap portion and the second edge is connected to a central portion of the convex rear surface.

9. The tool of claim 5, wherein one of the at least two blade members is removably mounted to the sheet member.

10. The tool of claim 5, wherein the second edge of the sheet member comprises a concave surface which corresponds to the convex rear surface.

11. The tool of claim 5, wherein the at least two blade members comprises first and second removably mounted blade members and wherein the sheet member connects each of the first and second removably mounted blades to the cap portion of the tool.

12. The tool of claim 5, wherein the sheet member comprises an open area between the at least two blade members which narrows to an inwardly curved edge.

13. The tool of claim 5, further comprising a third concave edge connected to a convex rear surface of another of the two blade members, and wherein a distance separating the two blade member increases continuously between the upper ends and the lower ends.

14. The tool of claim 5, wherein an area of the sheet member between the two blade members defines an open area between the upper ends and the lower ends, wherein the second edge is arranged on a portion of the sheet member that is tapered and narrows from an area of the upper ends to an area of the lower ends, and wherein the two blade members are identical to each other.

15. An excavating tool comprising:

a cap portion comprising a mechanism for pivotally mounting the excavating tool to an end of an arm;

at least two blade members each comprising a convex rear surface, a concave front surface, and a soil engaging end; and a sheet member comprising a first edge connected to a central portion of a surface of the cap portion and a second concave edge connected to a central portion of the convex rear surface of one of the at least two blade members, wherein a distance separating upper ends of the at least two blade members is smaller than a distance separating lower ends of the at least two blade members, and wherein a distance between the two adjacent blades measured at an angular midpoint between the upper and lower ends is smaller than the distance separating lower ends and greater than the distance separating the upper ends of the two adjacent blades.

16. The tool of claim 15, wherein the sheet member comprises an open area between the at least two blade members which narrows to an inwardly curved edge.

17. The tool of claim 15, further comprising a third concave edge connected to the convex rear surface of another of the two blade members, and wherein a distance separating the two blade members increases continuously between the upper ends and the lower ends.

18. The tool of claim 15, wherein an area of the sheet member between the two blade members defines an open area between the upper ends and the lower ends, wherein the second edge is arranged on a portion of the sheet member that is tapered and narrows from an area of the upper ends to an area of the lower ends, and wherein the two blade members are identical to each other.

* * * * *